US011470877B1

(12) United States Patent
Tumba

(10) Patent No.: US 11,470,877 B1
(45) Date of Patent: Oct. 18, 2022

(54) CIGARETTE BUTT HOLDING CONTAINER

(71) Applicant: Johan Tumba, North Palm Beach, FL (US)

(72) Inventor: Johan Tumba, North Palm Beach, FL (US)

( * ) Notice: Subject to any disclaimer, the term of this patent is extended or adjusted under 35 U.S.C. 154(b) by 0 days.

(21) Appl. No.: 17/228,923

(22) Filed: Apr. 13, 2021

(51) Int. Cl.
*B65D 85/10* (2006.01)
*A24F 15/18* (2006.01)

(52) U.S. Cl.
CPC ..... *A24F 15/18* (2013.01); *B65D 85/1081* (2013.01); *B65D 2209/00* (2013.01)

(58) Field of Classification Search
CPC ..... A45F 15/00; A45F 15/18; A45F 19/00; A45F 19/10; B65D 85/10; B65D 85/1045; B65D 85/1081; B65D 2209/00
USPC ..... 206/242–275, 566
See application file for complete search history.

(56) References Cited

U.S. PATENT DOCUMENTS 4,587,980 A 5/1986 Tipper
5,992,621 A 11/1999 Grant et al.
8,505,717 B2 8/2013 Urf et al.
10,358,282 B1 * 7/2019 Strickler ..... B65D 85/10
2014/0001066 A1 * 1/2014 Dong ..... B65D 85/1048 206/256
2018/0070631 A1 * 3/2018 Reynolds ..... A24F 19/10

FOREIGN PATENT DOCUMENTS

CN 201439422 U * 4/2010
WO WO-0147380 A1 * 7/2001 ..... A24F 15/18
WO WO-2017072909 A1 * 5/2017 ..... A24F 15/18

* cited by examiner

*Primary Examiner* — Bryon P Gehman
(74) *Attorney, Agent, or Firm* — Sanchelima & Associates, P.A.; Christian Sanchelima; Jesus Sanchelima

(57) ABSTRACT

A cigarette butt holding tube including a tube assembly, lid assembly, and a cigarette pack assembly is disclosed. These assemblies in conjunction with one another provide an easy-to-use cigarette butt disposal solution to help reduce littering. The cigarette pack assembly includes a spacing within the cigarette pack for a tube of the tube assembly to be received therein. The tube includes a tube opening at a top end that is larger than the width of a cigarette butt. The tube is selectively sealed by a lid of the lid assembly. Once a user is finished smoking a cigarette, the used cigarette butt can be conveniently disposed of and sealed within the tube. The tube being smell proof, fireproof, and fire resistant prevents the smell of smoke within the cigarette pack. The tube also prevents a still lit cigarette butt from setting fire to the remaining cigarettes.

9 Claims, 3 Drawing Sheets

CIGARETTE BUTT HOLDING CONTAINER

BACKGROUND OF THE INVENTION

1. Field of the Invention

The present invention relates to a cigarette butt holding tube and, more particularly, to a cigarette butt holding tube received within a cigarette pack for the disposal of used cigarette butts to help prevent pollution and littering caused by the cigarettes.

2. Description of the Related Art

Several designs for cigarette butt holding tubes have been designed in the past. None of them, however, include a tube for inserting into a cigarette pack having an internal diameter for storing cigarette butts.

Applicant believes that a related reference corresponds to U.S. Pat. No. 5,992,621 for a cigarette package capable of extinguishing and storing cigarette butts. Applicant believes another related reference corresponds to U.S. Pat. No. 4,587,980 for a portable cigarette holder, extinguisher, and ashtray. None of these references, however, teach of a smell proof nor fireproof tube for the disposal of used cigarette butts within a cigarette pack.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a cigarette butt holding tube which helps reduce pollution and littering caused by used cigarette butts.

It is another object of this invention to provide a cigarette butt holding tube that can be retrofitted into existing cigarette packs.

It is still another object of the present invention to provide a cigarette butt holding tube that is smell proof, fireproof, and fire resistant.

It is also another object of the present invention to provide a cigarette butt holding tube that is disposable.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
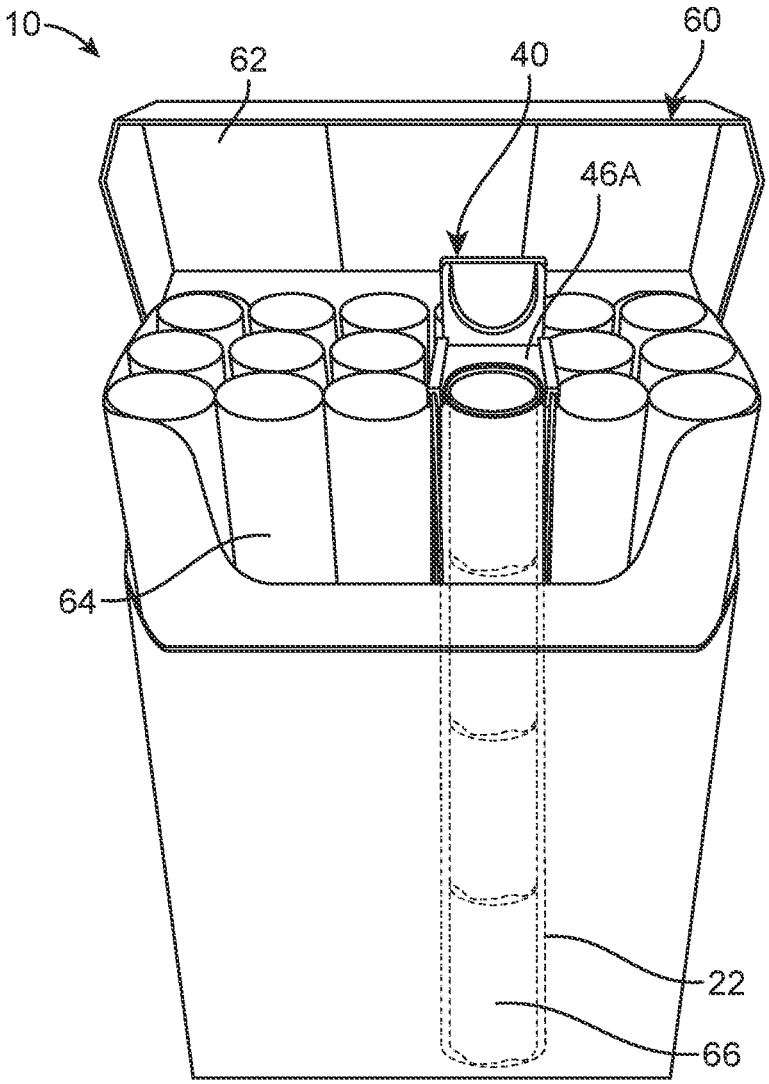
FIG. 1 represents an operational view of a cigarette butt holding tube 10 wherein a tube 22 of tube assembly 20 having a tube lid 42 of tube lid assembly 40 in an open configuration is secured within a cigarette pack 62 and contains used cigarette butts 66 within.

Referring now to the drawings, where the present invention is generally referred to with numeral 10, it can be observed that it basically includes a tube assembly 20, a tube lid assembly 40, and a cigarette pack assembly 60.

Figure 2:
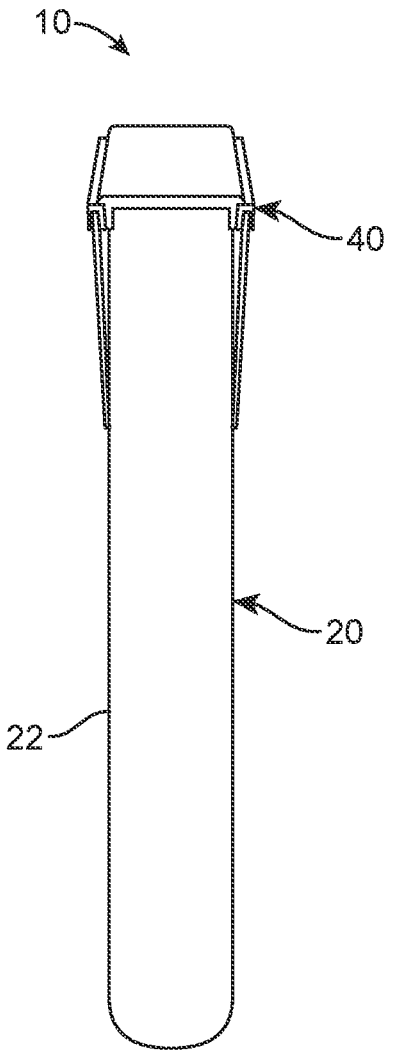
FIG. 2 shows an isometric view of a first embodiment to close tube assembly 20. Tube lid 42 of lid assembly 40 can be seen closing the top end of tube 22 using hinged means.

As best illustrated in FIGS. 1-2, tube assembly 20 includes a tube 22 having a tube opening 24 at a top distal end. In one embodiment, tube 22 may be made to have a rigid body while maintaining an internal diameter that is slightly larger than the used cigarette butts 66 of cigarette pack assembly 60 disposed of therein. In another embodiment, the body of tube 22 may be made of fireproof materials such as, silicone, fiberglass, mineral wool, or glass wool. Tube 22 may preferably have a height and width that cooperates with the internal dimensions of cigarette pack assembly 60 as best shown in FIG. 1. Thereby allowing tube 22 to be retrofitted within existing cigarette packages. Tube 22 may have an interior volume large enough to receive an unused cigarette. Tube 22 may also have interior dimensions that fit at least twenty used cigarette butts 66. In one embodiment, tube 22 may have a rounded distal end opposite of tube lid assembly 40 as illustrated in FIG. 2. In yet another embodiment of tube 22 the distal end opposite of tube lid assembly 40 may be flat.

Figure 4:
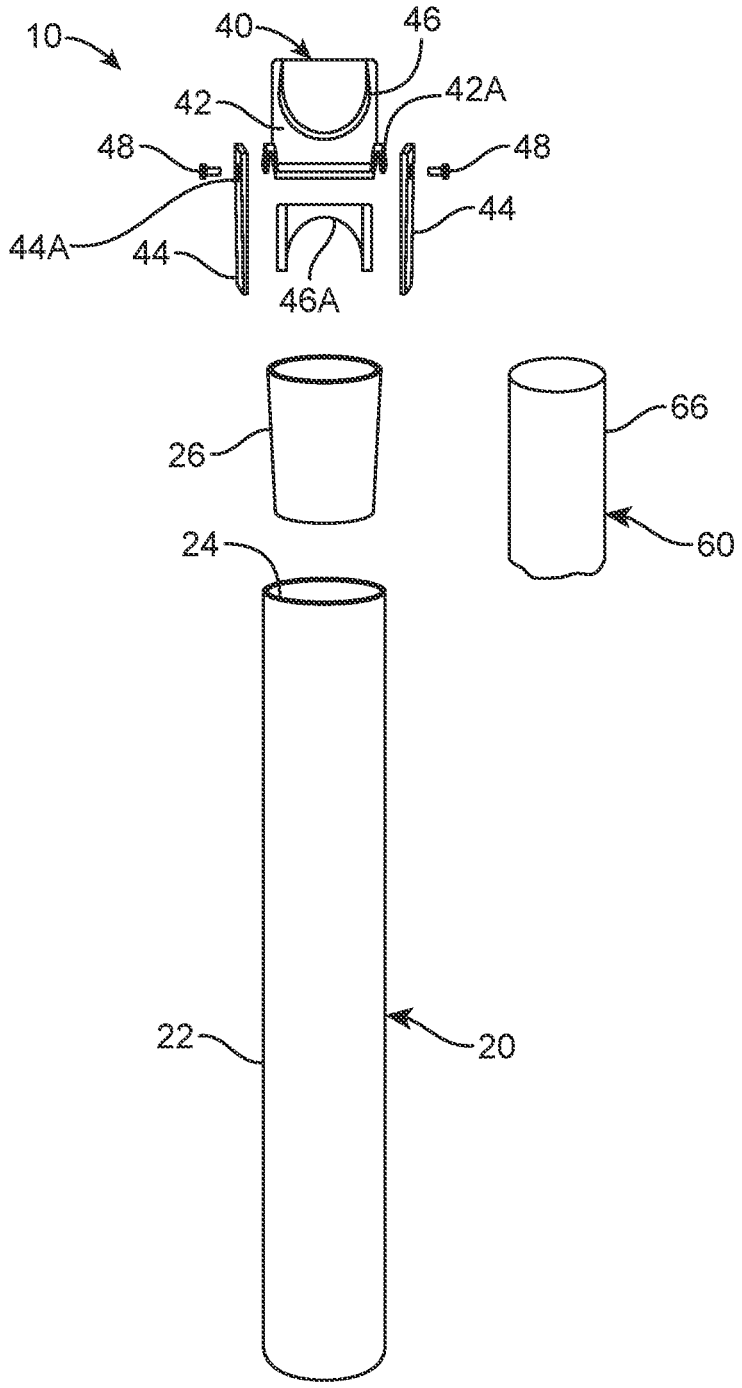
FIG. 4 is an exploded representation of cigarette butt holding tube 10 showing tube opening support 26 that goes into tube 22 and provides an anchoring point to attach lid leg attachments 44.

As best depicted in FIG. 4, a tube opening support 26 may be inserted within tube 22 through tube opening 24. Tube opening support 26 is secured at the top end of tube 22 and lines the inner perimeter of tube opening 24. Tube opening support 26 may be provided in a cylinder ring structure that is secured via pressure when inserted into tube 22 via tube opening 24. Alternatively, tube opening support 26 may be secured adhesively to the inside of tube 22. Tube opening support 26 extends from tube opening 24 to a predetermined portion of the way down into the interior of the body of tube 22. Tube opening support 26 may be made of a rigid material. In one embodiment, the material of tube opening support 26 may preferably be made of fireproof material such as, silicone, fiberglass, mineral wool, or glass wool. In another embodiment, tube opening support 26 may be tapered along its length while extending down into the body tube 22. Tube opening support 26 helps to provide an attachment point for the tube lid assembly 40 shown in FIG. 4.

The tube lid assembly 40 as shown in FIG. 4, includes a tube lid 42 hingedly fastened to the lid leg attachments 44 by pins 48. Lid leg attachments 44 may take the form of an elongated rectangle with a pin through hole 44A in the top end of the lid leg attachment 44. It may be suitable for one end of pin 48 to have a head portion and another end to have a body portion. The head portion being wider than pin through hole 44A to prevent pin 48 from being inserted entirely into pin socket 42A, which would cause a disengagement of the lid leg attachments 44 from tube lid 42. Pin 48 may be secured to the lid leg attachments 44 and inserted into pin through hole 44A to secured lid leg attachments 44 to tube lid 42. One end, the body portion end, of pin 48 may be entirely received within the pin socket 42A. Thereby allowing tube lid 42 to pivot about pin 48. Tube lid 42 may have an open configuration as depicted in FIG. 1 or a closed configuration as depicted in FIG. 2.

Tube lid 42 may achieve the closed configuration with a downward pressure applied by the user on tube lid 42 towards tube opening 24. It may be suitable for tube lid 42 to include a locking member 46 as well as a locking member support 46A to help tube lid 42 securely remain in the closed configuration. Tube lid 42 may close flush with locking member support 46A. While in a closed configuration tube lid 42 may create an airtight seal over tube opening 24. Thereby preventing any smoke or odor from escaping tube 22. One embodiment of locking member 46 may include a protruding concave arch. One embodiment of locking member support 46A may include an end closest to the tube lid 42 pivot point to have a square shaped end with the opposite end having a concave arch that is able to receive locking member 46. It may be preferable for locking member support 46A to be fastened flush to the top portion of tube 22 and having an arch wide enough to receive used cigarette butts 66. In one embodiment, lid leg attachments 44 may be fastened laterally to the upper outer portion of tube 22. In another embodiment, lid leg attachments 44 may be fastened to the inner portion of tube 22.

Figure 3:
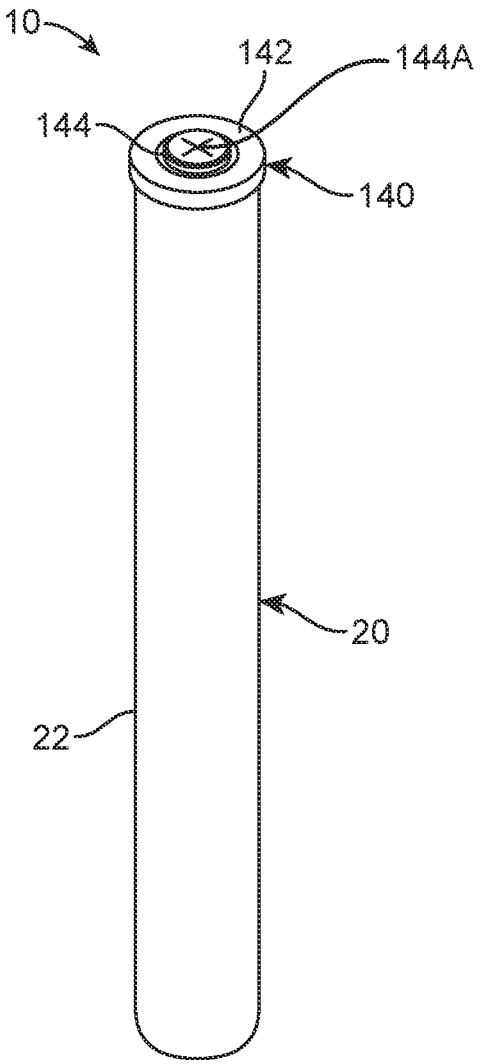
FIG. 3 illustrates a second embodiment to close tube assembly 20. lid assembly 140. Push through lid 142 can be seen having cigarette receiving membrane 144 that uses cut slits 144A to receive used cigarette butt 66 so that it can be housed within tube 22.

In an alternate iteration, it may be suitable for the present invention to include a tube lid assembly 140 as depicted in FIG. 3. Thereby replacing tube lid assembly 40 with tube lid assembly 140. Tube lid assembly 140 includes a push through lid 142 and a cigarette receiving membrane 144. Push through lid 142 may be of a wider width than that of tube 22. The wide width of push through lid 142 allows the lid to be securely fastened perimeter of tube opening 24 via pressure fitting. As such push through lid 142 may partially conceal the length of tube 22. In another embodiment, push through lid 142 may be secured adhesively atop of tube opening 24. The inclusion of push through lid 142 provides a more efficient method for the disposal of used cigarette butt 66. Push through lid 142 may be wide enough to allow for a user to push used cigarette butt 66 through cigarette receiving membrane 144 as best depicted in FIG. 3. Cigarette receiving membrane 144 enables the user to dispose of used cigarette butt 66 in a manner that does not require the opening and closing of tube lid 42. Being elastically biased to a normally closed position, cigarette receiving membrane 144 only opens when the user is pushing used cigarette butt 66 through cut slits 144A in the cigarette receiving membrane 144. Cigarette receiving membrane 144 closes by resiliently returning to the membranes' normally closed state immediately after the cigarette clears the cut slits 144A in cigarette receiving membrane 144. The quick opening and closing action of cigarette receiving membrane 144 is crucial in preventing the smell of cigarette smoke escaping tube assembly 20. It may be suitable for cigarette receiving membrane 144 to be made of silicone. The closing action of cigarette receiving membrane 144 also helps in the prevention of accidental burns. This is accomplished by smothering any remaining embers that may still be ignited at the time the user attempts to dispose of used cigarette butt 66.

Ideally the present invention 10 may fit within the dimensions of cigarette pack assembly 60. As best illustrated in FIG. 1, cigarette pack assembly 60 includes a cigarette pack 62, and cigarettes 64. Cigarette butt holding tube 10 may be within cigarette pack 62 in a spacing between cigarettes 64 still to be smoked. Cigarette butt holding tube 10 may be partially surrounded by cigarettes 64 within cigarette pack 62. The accommodation space within cigarette pack 62 may be ample enough for cigarette butt holding tube 10 to fit entirely concealed within cigarette pack 62. It is to be understood that preferably, tube 22 may fit parallel with respect to other cigarettes 64 within cigarette pack 62. The top distal end of cigarette butt holding tube 10 may be flush with the top distal end of cigarettes 64 within cigarette pack 62. In one embodiment cigarette butt holding tube 10 may be held upright by surrounding cigarettes 64 in constant abutting contact therewith. In another embodiment, cigarette butt holding tube 10 may be held in an upright position by being fastened to the inner perimeter wall of cigarette pack 62. It may be suitable for tube 22 to be have dimensions substantially similar to the unsmoked cigarettes 64 within cigarette pack 62.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A cigarette butt holding tube, comprising:

a. a tube lid assembly; and b. a tube, wherein said tube includes a tube opening at a top portion, said tube including a tube opening support being mounted lining an inner perimeter of the tube opening, the tube lid assembly creating a seal with said tube opening support when in a closed configuration, said lid assembly includes lid leg attachments mounted to an exterior of said tube, said tub lid assembly further includes a tube lid hingedly mounted to said lid leg attachments.

2. A cigarette butt holding tube of claim 1 wherein said tube lid assembly engages a lid locking member with a lid locking member support.

3. A cigarette butt holding tube of claim 1 wherein said tube lid assembly includes a push through lid mounted to a top edge of said tube opening.

4. A cigarette butt holding tube of claim 3 wherein said push through lid includes a cigarette receiving membrane being elastically biased.

5. A cigarette butt holding tube of claim 4 wherein said cigarette receiving membrane includes cut slits.

6. A cigarette butt holding tube of claim 5 wherein said push through lid having a circular shape.

7. A cigarette butt holding tube of claim 1 wherein said tube made of silicone.

8. A cigarette butt holding tube, comprising:

a. a tube lid assembly, wherein said tube lid assembly includes a push through lid mounted to a top edge of a tube opening, said push through lid includes a cigarette receiving membrane being elastically biased, wherein said cigarette receiving membrane includes cut slits in an X formation; and b. a silicone tube, wherein said tube includes said tube opening at a top portion and a rounded bottom portion, said tube including a tube opening support being mounted lining an inner perimeter of the tube opening.

9. A cigarette butt holding tube, consisting of:

a. a cigarette pack that holds at least twenty cigarettes; and b. a tube lid assembly including a circular push through lid mounted to a top edge of a tube opening, said push through lid includes a cigarette receiving membrane being elastically biased, wherein said cigarette receiving membrane is centrally located within a circumference of the circular push through lid, said cigarette receiving membrane further includes cut slits in an X formation; and c. a silicone tube, wherein said silicone tube includes said tube opening at a top portion and a rounded bottom portion, said tube including a tube opening support being mounted lining an inner perimeter of the tube opening, said tube lid assembly and the tube assembly fitting entirely and vertically within the cigarette pack, wherein one of the at least twenty cigarettes fits within the tube.

* * * * *